US009393448B2

(12) United States Patent
Dwyer et al.

(10) Patent No.: US 9,393,448 B2
(45) Date of Patent: Jul. 19, 2016

(54) SIDE PLUG-IN FILTER CARTRIDGE

(75) Inventors: Gary E. Dwyer, Mallorytown (CA); Pierre Legare, Brockville (CA)

(73) Assignee: 3M Innovative Properties Company, St. Paul, MN (US)

( * ) Notice: Subject to any disclaimer, the term of this patent is extended or adjusted under 35 U.S.C. 154(b) by 134 days.

(21) Appl. No.: 13/298,402

(22) Filed: Nov. 17, 2011

(65) Prior Publication Data

US 2013/0125896 A1 May 23, 2013

(51) Int. Cl.

| | |
|---|---|
| ***A62B 18/02*** | (2006.01) |
| ***A62B 23/02*** | (2006.01) |
| ***A62B 7/10*** | (2006.01) |
| ***A62B 9/04*** | (2006.01) |

(52) U.S. Cl.

CPC ..... *A62B 18/025* (2013.01); *A62B 7/10* (2013.01); *A62B 9/04* (2013.01); *A62B 18/02* (2013.01); *A62B 23/02* (2013.01); *Y10T 29/49826* (2015.01)

(58) Field of Classification Search

CPC ..... A61M 16/06; A62B 7/10; A62B 18/00; A62B 18/02; A62B 18/025; A62B 18/04; A62B 18/045; A62B 18/06; A62B 9/04; A63B 23/02

USPC ..... 128/202.27, 203.29, 205.25, 205.27, 128/206.17, 206.21–207.13

See application file for complete search history.

(56) References Cited

U.S. PATENT DOCUMENTS

| | | | | |
|---|---|---|---|---|
| 2,055,853 A | | 9/1936 | Schwartz | |
| 2,062,834 A | | 12/1936 | Schwartz | |
| 2,235,624 A | | 3/1941 | Schwartz | |
| 2,787,333 A | | 4/1957 | Boone | |
| 4,932,399 A | * | 6/1990 | Cappa et al. | 128/202.27 |
| 5,062,421 A | * | 11/1991 | Burns et al. | 128/205.27 |
| 5,086,768 A | * | 2/1992 | Niemeyer | 128/205.24 |
| RE35,062 E | | 10/1995 | Brostrom | |
| 5,579,761 A | * | 12/1996 | Yuschak et al. | 128/206.17 |
| 5,611,925 A | | 3/1997 | Yasue | |

(Continued)

FOREIGN PATENT DOCUMENTS

| | | |
|---|---|---|
| EP | 0172923 | 7/1992 |
| GB | 759802 | 10/1956 |

(Continued)

OTHER PUBLICATIONS

Koken Particulate Respirators webpage, http://www.koken-ltd.co.jp/english/particulaterespirators.htm, obtained from internet on Jun. 3, 2013.

(Continued)

*Primary Examiner* — Valerie L Woodward

(57) ABSTRACT

A respirator 10 that includes a mask body 14, a filter cartridge receptacle 15, and a filter cartridge 12. The filter cartridge 12 has a side 30 that is capable of being plugged into the receptacle 15. The filter cartridge 15 can be inserted into the proper position within the receptacle 15 while the mask body 14 is being donned. The securement can be achieved without having the user visibly witness the actual engagement. An audible click or other indication can be provided so that the user knows that proper engagement has been achieved. The engagement may exhibit little spacing between the filter cartridge 12 and the mask body 14, thereby improving viewer visibility and making the inventive respirator 10 more comfortable to wear.

19 Claims, 8 Drawing Sheets

(56) References Cited

U.S. PATENT DOCUMENTS

| | | | | |
|---|---|---|---|---|
| 5,666,949 | A * | 9/1997 | Debe et al. | 128/202.22 |
| 5,669,375 | A * | 9/1997 | Dahrendorf et al. | 128/206.17 |
| 6,550,479 | B1 * | 4/2003 | Duxbury | 128/205.27 |
| 6,761,169 | B2 | 7/2004 | Eswarappa | |
| 6,793,702 | B2 * | 9/2004 | Eswarappa | A62B 7/10 128/206.17 |
| 2001/0013347 | A1 * | 8/2001 | Rekow et al. | 128/205.27 |
| 2002/0017085 | A1 | 2/2002 | Eswarappa | |
| 2002/0026942 | A1 * | 3/2002 | Eswarappa | A62B 7/10 128/205.27 |
| 2002/0195109 | A1 | 12/2002 | Mittelstadt | |
| 2003/0217752 | A1 | 11/2003 | Muller | |
| 2004/0003810 | A1 * | 1/2004 | Templeton et al. | 128/201.22 |
| 2005/0126572 | A1 | 6/2005 | Gosweiler | |
| 2005/0145249 | A1 * | 7/2005 | Solyntjes et al. | 128/205.25 |
| 2007/0144123 | A1 * | 6/2007 | Angadjivand et al. | 55/486 |
| 2010/0199995 | A1 * | 8/2010 | Howie | 128/206.15 |
| 2012/0000465 | A1 * | 1/2012 | Cavaliere et al. | 128/202.27 |
| 2012/0024289 | A1 * | 2/2012 | Johnstone et al. | 128/205.12 |
| 2012/0174922 | A1 * | 7/2012 | Virr et al. | 128/203.12 |

FOREIGN PATENT DOCUMENTS

| | | |
|---|---|---|
| KR | 10-0773460 B1 | 11/2007 |
| RU | 109665 | 10/2011 |
| WO | WO 03/090873 A1 | 11/2003 |
| WO | WO 2011/006206 | 1/2011 |
| WO | WO 2011/146294 | 11/2011 |

OTHER PUBLICATIONS

International Application No. PCT/US2012/063801 International Search Report dated Mar. 21, 2013.

European Application 12850170 Search Report dated Oct. 13, 2015.

* cited by examiner

SIDE PLUG-IN FILTER CARTRIDGE

The present invention pertains to a respirator that has a side plug-in filter cartridge.

BACKGROUND

Respirators commonly include a mask body and one or more filter cartridges that are attached to the mask body. In use, air is drawn through the filter cartridge by a negative pressure generated by the wearer during an inhalation. The ambient air passes through the filter medium to enter the mask body interior where the filtered air is then safely inhaled by the wearer.

Many techniques have been used in the respirator art to attach filter elements to respirators. A common technique has the filter element disposed in a threaded cartridge that is attached to a corresponding threaded fitting on the body of the respirator; see, for example, U.S. Pat. Nos. 5,222,488, 5,063,926, 5,036,844, 5,022,901, 4,548,626, and 4,422,861. Known filter cartridges typically possess helical or advancing spiral threads that mate with a tapped collar or socket that receives the threaded portion of the filter cartridge. Rotating the filter cartridge in an appropriate direction allows the cartridge to be attached to or removed from the respirator.

In lieu of threads, a bayonet type closure has been used to attach a filter cartridge to a respirator—see, for example, U.S. Pat. Nos. 5,062,421, 4,934,361, and 4,850,346. The bayonet type closure disclosed in the '421 patent has locking tabs and notches to secure the components together. In the '361 and '346 patents, an audible device is used to indicate that the filter cartridge is properly coupled to the respirator face piece. A lug on the face piece is provided with a detent ramp or cam having an inclined surface that is positioned to gradually deflect or deform a rib on the cartridge. As the cartridge and face piece are rotated relative to each other into a locking position, the cam engages the rib and causes the rib and lug to deflect until the rib abruptly drops off the end of the cam to produce the audible click.

Snap-in engagements have been developed where the filter cartridge is manually pressed against the mask body without rotational movement to cause an audible engagement—see U.S Pat. No. Re. 39,493 to Yuschak et al. By manually pulling on the cartridge in the opposite direction, disengagement can be achieved.

In addition to threads, bayonets, and snap-fits, a variety of other connections have been developed over the years. In U.S. Pat. No. 5,148,803, for example, a bellows is used to fasten a filter to the respirator. The bellows, together with a rigid band, form a rigid cuff that receives the filter. U.S. Pat. Nos. 5,033,465 and 5,078,132 disclose the use of edge seals to secure a filter element to an elastomeric face piece. In U.S. Pat. No. 4,856,508, a foam mask shell is disclosed for receiving a filter cartridge. The foam mask shell possesses a collar that defines an opening for receiving the filter cartridge. In U.S. Pat. No. 4,790,306, insert molding is used to permanently secure a bonded absorbent filter element to a respirator face piece. A plug-in frame is described in U.S. Pat. No. 4,771,771 to secure a filter cartridge in a chamber of the respirator. The filter cartridge can be fitted to the respirator by sliding it through an opening in the plug-in frame. In U.S. Pat. No. 4,630,604, locking tongues are employed on a filter retainer to hold a replaceable filter member in an abutting relationship to the respirator frame. The filter member can be replaced by snapping off the filter retaining member from the frame. A further technique is disclosed in U.S. Pat. No. 4,562,837 where the respirator is provided with a guide ring for engaging a filter housing. The guide ring is carried by a sleeve portion that defines an opening through which the gasses pass. The filter housing slides on the guide ring from a retracted stand-by position to an extended use position.

Although the above-discussed respirators use various techniques for securing a filter and filter cartridges to respirators, these techniques have some drawbacks. For example, the filter cartridges that are threaded to the respirator typically require multiple turns to attach the cartridge to the mask body. The cylindrical geometry typically requires using the filter cartridge as an external appendage that can interfere with a wearer's vision. In other constructions, the filter cartridges may be attached with little or no rotational movement, but these devices nonetheless may project somewhat from the mask body surface. The further that a filter cartridge resides from the mask body, the greater the moment is, and thus more gravitational torque may be placed on the wearer's neck. In known respirators, the attachment commonly occurs on the inward major face of the filter cartridge, which often requires that the two parts be spaced from each other somewhat to allow for the engagement of the two parts. A final drawback to conventional designs is that a distinguishing appearance exhibiting modern appeal is sometimes lacking.

GLOSSARY

The terms set forth below will have the meanings as defined:

"active particulate" means particles or granules that are specifically suited to perform some action or function attributable to some characteristic or property including chemical properties such as catalysis and/or ion exchange and/or physical properties such as entrapment, adsorption, absorption, or combinations thereof;

"clean air" means a volume of atmospheric ambient air that has been filtered to remove contaminants;

"exterior gas space" means the ambient atmospheric gas space into which exhaled gas enters after passing through and beyond the mask body and/or exhalation valve;

"filter cartridge" means a device that is attachable (removably or permanently) to a respirator mask body for purposes of filtering air before it enters the interior gas space;

"filter cartridge receptacle" means a device sized and adapted for receiving a portion of a filter cartridge;

"filter media" means an air-permeable structure that is designed to remove contaminants from air that passes through it;

"housing sidewall" means an air-impermeable surface that is located at at least a portion of the side of the structure;

"integral" means made at the same time or incapable of being separated without damaging one or more of the integral parts;

"interior gas space" means the space between a mask body and a person's face;

"major surface" means one or two of the surfaces that have the largest surface area on a device, typically the surface(s) through which air passes to enter a filter cartridge;

"mask body" means a structure that fits at least over the nose and mouth of a person and that helps define an interior gas space separated from an exterior gas space;

"plenum" means an area or space where more than one airflow path converges or meets another airflow path or where more than one airflow path diverges from the area or space;

"plurality" means two or more;

"plugged into" means that one part engages another part through an act that includes manually sliding the one part into the other;

"respirator" means a device that is worn by a person to filter air before the air enters the person's respiratory system;

"secured" means joined together; and

"side" or "edge" in reference to the filter cartridge means a surface, or combination of surfaces, that resides in whole or in part between the major surfaces of a filter cartridge; and "side portion" means a portion that includes a side and that may include one or more portions of the major surfaces adjacent to the side.

SUMMARY OF THE INVENTION

The present invention provides a new respirator that has a unique system for attaching a filter cartridge to a mask body. Like known respirators, the inventive respirator comprises a mask body and one or more filter cartridges that are attached, or attachable, to the mask body. The invention differs from known respirators in that it also comprises a filter cartridge receptacle and a filter cartridge that has a first side portion that is capable of being plugged into the receptacle.

The present invention also provides a new method of making a respirator, which method comprises: (a) providing a mask body that has a receptacle joined thereto; (b) providing a filter cartridge that has a means for attachment located at a side portion on the cartridge; and (c) plugging the filter cartridge into the receptacle such that the means for attachment engages a corresponding part in the receptacle to cause the filter cartridge to be secured to the mask body via the receptacle.

The filter cartridge may be slid into the receptacle such that an audible "click" or other indication may occur, which tells the user that the two parts have been engaged.

The present invention is beneficial in that the cartridge can be inserted into proper position while the mask body is being donned by the wearer. The securement may be achieved without having the user visibly witness the actual engagement. The use of a receptacle and a plug-in function makes it relatively easy for the user to secure the cartridge to the mask body. A side portion or end of the cartridge end is merely inserted into the receptacle, and the cartridge is pressed toward the rear of the receptacle. The cartridge slides into engagement with the receptacle. The audible click or other indication lets the user know that proper engagement has been achieved. Additionally, the invention enables an engagement where there is little spacing between the cartridge and the mask body. The inventive respirator therefore may be more comfortable to wear. The further that a cartridge resides from the mask body, the larger the resulting moment is. Conventional respirators that use filter cartridges may exhibit more torque upon the wearer's neck and thereby cause more wearer discomfort when the mask is worn for an extended time period. The invention also may make room for additional clearance to the mask body for other personal protective equipment, such as face shields and hearing protection. A final benefit of the present invention is that the new attachment method is quite distinguishing in look and appeal, giving the user the sense of wearing a respirator of highest quality and nonconventional design

DETAILED DESCRIPTION

In practicing the present invention, a respirator is provided that comprises a mask body and one or more filter cartridges that are attached, or attachable, to the mask body via a filter cartridge receptacle. The filter cartridge(s) have a first side portion that is capable of being plugged into the receptacle. The provision of a filter cartridge receptacle and a filter cartridge that can be secured to the mask body through the receptacle allows for a new cartridge attachment which does not need rotations or varied manipulations to create an attachment to the mask body. The cartridge can be quickly plugged into the receptacle and be ready for use. Further, as described below in detail, rapid disengagement may be achieved by the user simply by pushing a disengagement mechanism like one or more buttons.

Figure 1:
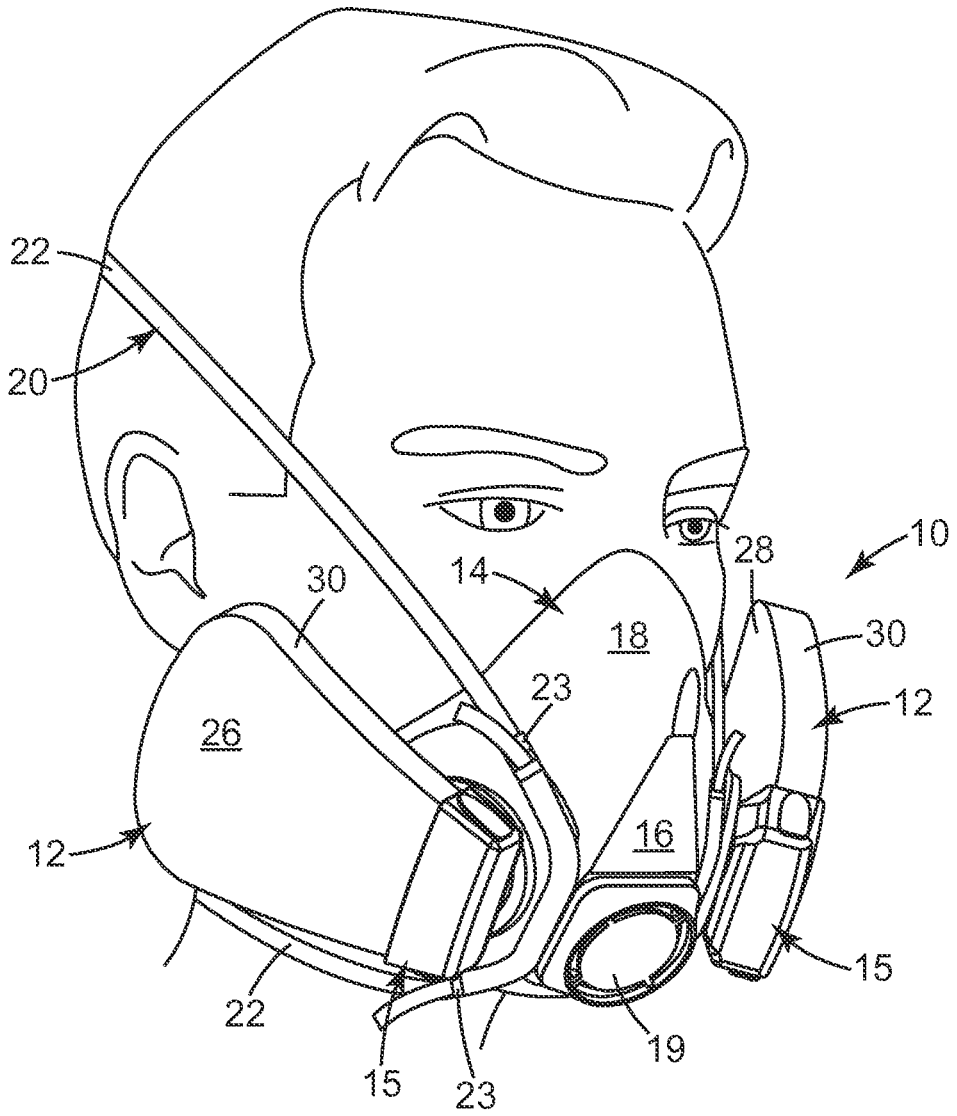
FIG. 1 is a perspective view of a respirator 10 in accordance with the present invention.

FIG. 1 illustrates an example of a respirator 10 having features in accordance with the present invention. The respirator 10 may be worn by a person on their head, covering the nose and mouth. The respirator 10 has one or more filter cartridges 12 located on opposing sides of a mask body 14. The filter cartridges 12 may be detachable or permanently secured to the mask body 14 via the receptacle 15. The cartridges 12 filter ambient air before it passes into the interior gas space located within the mask body 14. The air that becomes present in the interior gas space is clean air that it suitable for wearer inhalation. The mask body 14 may include a rigid insert 16 and an elastomeric face-contacting portion 18. A mask body having such a construction is described in U.S. Pat. No. 7,650,884 to Flannigan et al. and U.S. Pat. No. 5,062,421 to Burns et al. An exhalation valve 19 may be placed on the mask body to allow exhaled air to be rapidly purged from the mask body interior. Examples of exhalation valves that may be suitable for use on a mask body of the invention include the valves that are disclosed in U.S. Pat. Nos. RE 37,974, 6,584,974, 5,509,436, 5,325,892, and 7,849,856B2. The respirator 10 also has a harness 20 for supporting the mask body 14 on the wearer's head when the respirator is being worn. The harness 20 may take on various configurations but commonly includes one or more straps 22 that pass behind the wearer's head. The straps 22 may be joined together by one or more buckles 23. The harness 20 may be, for example, a drop-down harness as described in U.S. Pat. Nos. 6,732,733B1 and 6,457,473 to Brostrom et al., U.S. Pat. No. 5,691,837 to Byram, and U.S. Pat. No. 5,237,986 to Seppala et al. A crown member optionally also may be employed to assist in supporting the mask body 14 on the wearer's head—see for example U.S. Patent Application Publication 2011/0220115A1 to Castiglione et al. and U.S. Pat. No. 6,732,733 to Brostrom et al. The filter cartridges 12 that are secured to the mask body 14 have first and second major surfaces 26 and 28 and a housing sidewall 30. The housing sidewall 30 extends at least from the first major surface 26 to at least the second major surface 28. The housing sidewall 30 commonly meets the perimeter of the layer(s) of filter media that are located therein. At the side portion of the cartridge housing, one or both of the major surfaces 26 and 28 meet the side 30. These surfaces 26 and 28 may be fluid permeable to allow ambient air to enter the filter cartridge 12. The major surfaces 26 and 28 typically each have a surface area of about 30 to 200 square centimeters ($cm^2$), more typically about 60 to 90 $cm^2$. The respirator may be fashioned such that there is little to no spacing between the cartridges and the mask body, in particular between the second major surface 28 and the mask body 14. At their closest distance, the spacing between the cartridge and the mask body may be less than 1 centimeter (cm), less than 0.5 cm, and even less than 2 millimeters (mm), or flush with the mask body. As shown, the filter cartridges 12 are joined to the mask body 14 through the filter cartridge receptacle 15.

Figure 2:
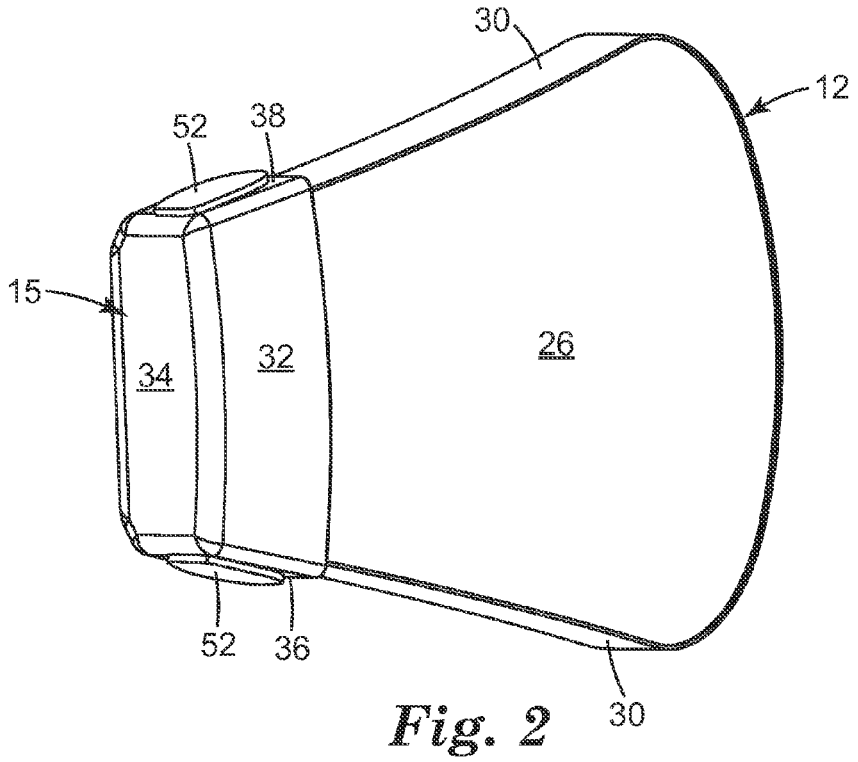
FIG. 2 is a perspective view of an assembled filter cartridge 12 and a filter cartridge receptacle 15 in accordance with the present invention.

FIG. 2 illustrates a front view of the filter cartridge 12 joined to the filter cartridge receptacle 15. The receptacle 15 includes a top surface 32, a front side 34, and first and second opposing sides 36 and 38. The inner compartment, formed by the interior of these sides and surfaces, has a cross-sectional area that is slightly larger than the side portion or mating end 40 (FIG. 3) of the filter cartridge 12, enabling the filter cartridge 12 to be securely inserted into the receptacle 15. Thus, the mating of the mask body 14 to the filter cartridge 12 may be achieved by inserting a male end 40 of the filter cartridge into the female receptacle 15 that is secured to the mask body 14.

As illustrated, the filter cartridge 12 may be curved from front to back. The cartridge also may be curved from top to bottom, or in both directions. A curved filter cartridge may enhance wearer visibility. An example of a filter cartridge that may have the general shape or construction suitable for use in connection with the present invention is shown in U.S. patent application Ser. No. 12/784,182, entitled Method of Making Filter Cartridge Having Roll-based Housing Sidewall, to Billingsley et al. An example of a plenum that may be used in the filter cartridge is disclosed in U.S. Patent Application 2007/0144123 to Angadjivand et al. The filter cartridge contains filter media that may include one or more layers of particulate and/or gaseous filter media. Particulate filter media is fashioned to remove particulates that are suspended in the ambient air, and the gaseous media is fashioned to remove vapors that are suspended therein. The filtration layer may come in a variety of shapes and forms and typically has a thickness of about 0.2 millimeters (mm) to 1 centimeter (cm), and it could be a generally planar web or it could be corrugated to provide an expanded surface area—see, for example, U.S. Pat. Nos. 5,804,295 and 5,656,368 to Braun et al. The filtration layer also may include multiple filtration layers joined together by an adhesive or any other suitable means. The filtering material also could include a series of parallel channels as described in U.S. Pat. Nos. 6,752,889 and 6,280,824 to Insley et al. Essentially any suitable material that is known (or later developed) for forming a filtering layer may be used for the filtering material. Webs of melt-blown fibers, such as those taught in Wente, Van A., *Superfine Thermoplastic Fibers,* 48 Indus. Engn. Chem., 1342 et seq. (1956), especially when in a persistent electrically charged (electret) form are especially useful (see, for example, U.S. Pat. No. 4,215,682 to Kubik et al.). These melt-blown fibers may be microfibers that have an effective fiber diameter less than about 20 micrometers (μm) (referred to as BMF for "blown microfiber"). Effective fiber diameter may be determined according to Davies, C. N., *The Separation Of Airborne Dust Particles*, Institution Of Mechanical Engineers, London, Proceedings 1B, 1952. BMF webs that contain fibers formed from polypropylene, poly(4-methyl-1-pentene), and combinations thereof are commonly used. Electrically charged fibrillated-film fibers as taught in van Turnhout, U.S. Pat. No. Re. 31,285, also may be suitable, as well as rosin-wool fibrous webs and webs of glass fibers or solution-blown, or electrostatically sprayed fibers, especially in microfilm form. Electric charge can be imparted to the fibers by contacting the fibers with water as disclosed in U.S. Pat. No. 6,824,718 to Eitzman et al., U.S. Pat. No. 6,783,574 to Angadjivand et al., U.S. Pat. No. 6,743,464 to Insley et al., U.S. Pat. Nos. 6,454,986 and 6,406,657 to Eitzman et al., and U.S. Pat. Nos. 6,375,886 and 5,496,507 to Angadjivand et al. Electric charge also may be imparted to the fibers by corona charging as disclosed in U.S. Pat. No. 4,588,537 to Klasse et al. or by tribocharging as disclosed in U.S. Pat. No. 4,798,850 to Brown. Also, additives can be included in the fibers to enhance the filtration performance of webs produced through the hydro-charging process (see U.S. Pat. No. 5,908,598 to Rousseau et al.). Fluorine atoms, in particular, can be disposed at the surface of the fibers in the filter layer to improve filtration performance in an oily mist environment—see U.S. Pat. Nos. 6,398,847B1, 6,397,458B1, and 6,409,806B 1 to Jones et al. Typical basis weights for electret BMF filtration layers are about 10 to 100 grams per square meter. Packed beds of active-particulate also may be used as well as permeable shaped structures of active-particulate which are held together with, for example, PSA microparticulate—see U.S. Pat. No. 6,391,429 to Senkus et al—or bonded sorbent particulate as described in U.S. Pat. No. 5,033,465 to Braun et al. An example of a fibrous matrix that contains active particulate is shown in U.S. Pat. No. 7,501,012B2 to Tatarchuk et al. The active-particulate that may be used in the filters of the present invention include particles or granules that are suited to perform some action or function attributable to some characteristic or property, including chemical change properties such as reaction, catalysis, and ion exchange, and/or physical properties such as high surface area, porosity, and relatively small size and shape. One example of active-particulate is particles that interact with components in a fluid to remove or alter their composition. The components in the fluid may be sorbed onto or into the active-particulate, or they may be reacted to make their composition more benign. The active-particulate accordingly may be sorptive, catalytic, or reactive. Examples of active-particulate materials that may be used in connection with the present invention include sorbent micro-particulate granules, such as active carbon, chemically surface-treated activated carbon, alumina, silica gel, bentonite, kaolin diatomaceous earth, powdered zeolites (both natural and synthetic), ion exchange resins and molecular sieves, and particulates such as catalytic particles and particles containing encapsulated compounds. Commonplace active-particulates include activated carbon, chemically-treated carbon, and alumina particulate. Examples of commercially available activated carbon that may be used in the present invention include Kuraray 12×20 type GG (available from Kuraray Chemical Corporation, Osaka, Japan and Calgon 12×30 URC available from Calgon Carbon Corporation, Pittsburgh, PA. Patents that describe various types of active-particulate that may be used in the present invention include U.S. Pat. No. 7,309,513 to Brey et al., and U.S. Pat. Nos. 7,004,990 and 6,391,429 to Senkus et al., U.S. Pat. No. 5,763,078 to Braun et al., and U.S. Pat. No. 5,496,785 to Abler. Cover webs also may be used to protect the filter layers. The cover webs may be fashioned to have few fibers protruding from the web surface after processing to exhibit a smooth outer surface. Examples of cover webs that may be used in the present invention are disclosed, for example, in U.S. Pat. No. 6,041,782 to Angadjivand, U.S. Pat. No. 6,123,077 to Bostock et al., and WO 96/28216A to Bostock et al. The filter cartridge also may have a sensor located on the side of the cartridge to tell the user when the service life of the cartridge has been met—see U.S. Patent application 2008/0063575 to Rakow et al.

Figure 3:
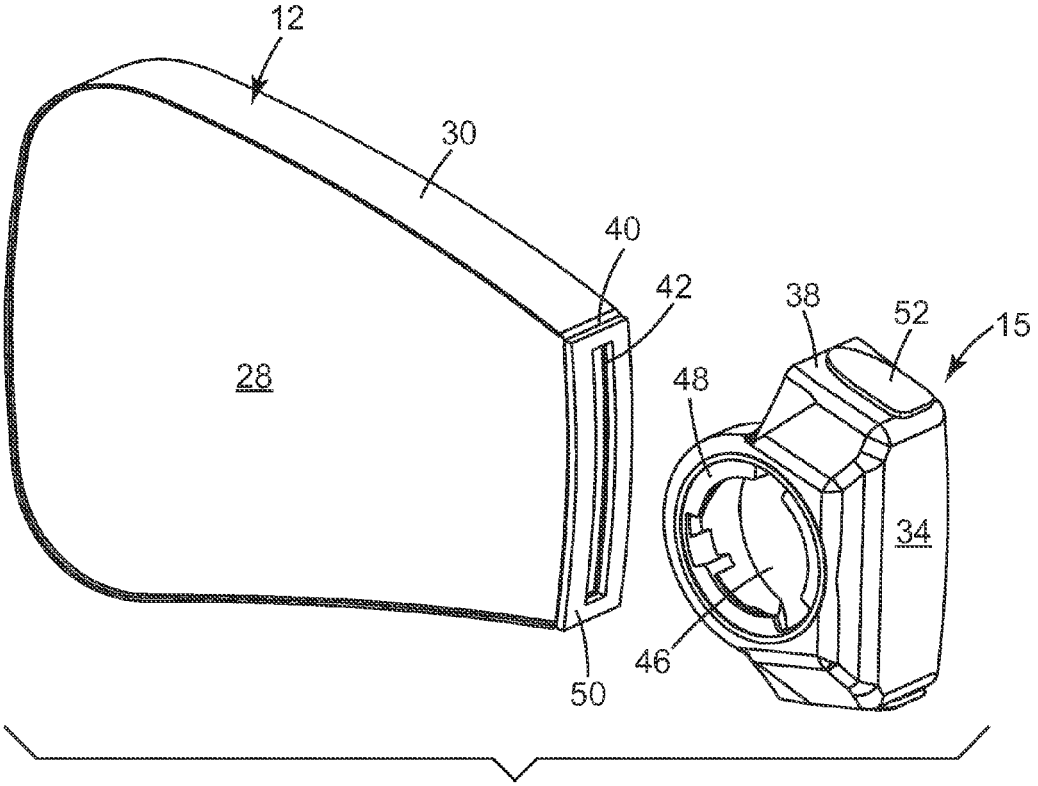
FIG. 3 is a perspective view of a separated filter cartridge 12 and a filter cartridge receptacle 15 in accordance with the present invention.
Figure 4:
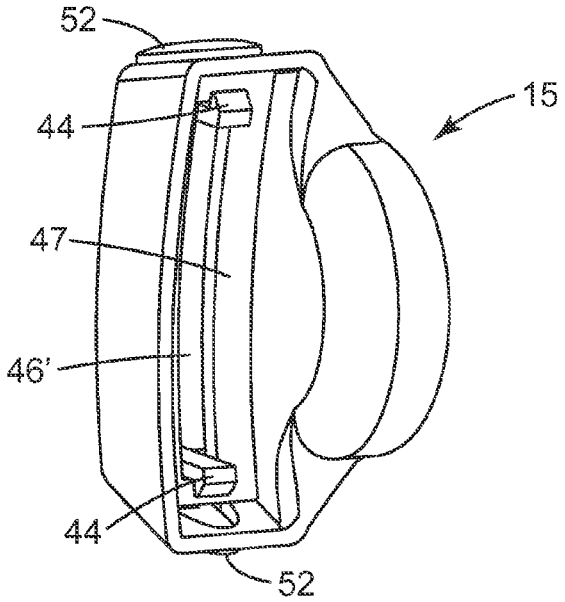
FIG. 4 is a perspective view of an attachment mechanism for a filter cartridge receptacle 15 in accordance with the present invention.

FIG. 3 shows that the male end 40 of the filter cartridge 12 may be fashioned to have one or more openings 42 disposed therein which would mate with retractable notches 44 (FIG. 4) in the receptacle 15. In use, air that passes through at least one of the first and second major surfaces 26 and 28 of the filter cartridge 12 enters a plenum that is in fluid communication with the opening 46 in the bayonet fitting 48. Thus, the bayonet fitting 48 may contribute to both a fluid communication and a securement means. Conduit 42 at sidewall 50 allows for the passing of air from the plenum located in the cartridge interior to the receptacle 15. The location of the outlet 42 on the side 50, as opposed to the major surface 28, may enlarge the effective filtering area on the filter cartridge surface 12, which may result in improved product performance FIG. 4 shows that the receptacle 15 may include one or more manually responsive buttons 52 that cause the retractable notches 44 to be disengaged from the opening 42 in the first side 40 of the filter cartridge 12. When the buttons 52 are pressed towards each other, the notches 44 similarly move towards each other to disengage from an interior surface of the sidewall 50, allowing the first end 40 of the cartridge 12 to be manually pulled from the receptacle interior. The disengagement mechanism used in the present invention, which includes the buttons 52, may be spring loaded to enable a sound securement to be achieved. As shown in this FIG. 4, the receptacle 15 can have a fluid exit opening 46' located on the front side 34 of the receptacle 34 rather than in a bayonet fitting 48 (FIG. 3) to allow air to pass into the mask body interior.

Figure 5:
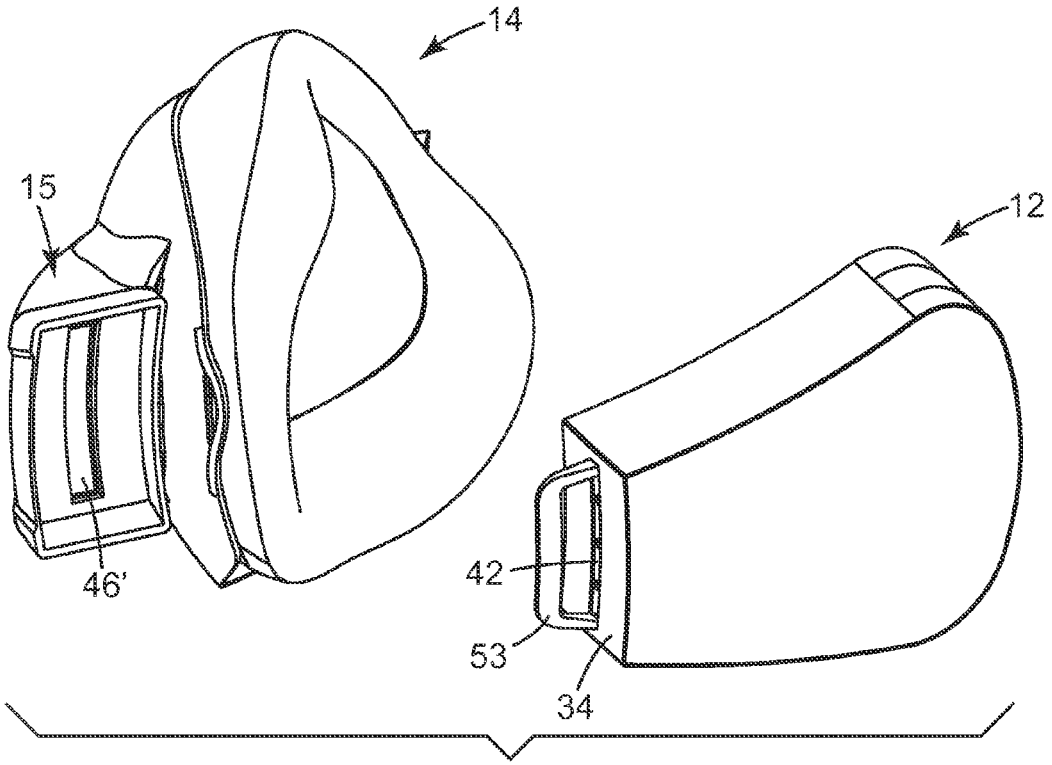
FIG. 5 is a rear perspective view of a second embodiment of a filter cartridge 12 and a receptacle 15 in accordance with the present invention.
Figure 6:
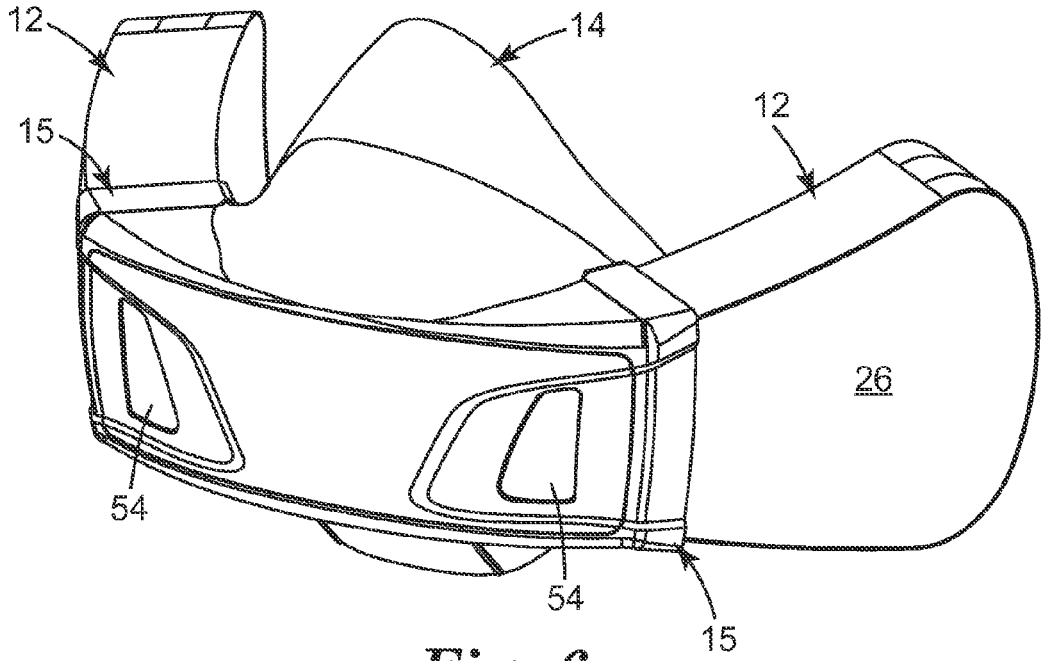
FIG. 6 is a front perspective view of a second embodiment of the filter cartridge 12 being inserted in the receptacle 15 in accordance with the present invention.
Figure 7:
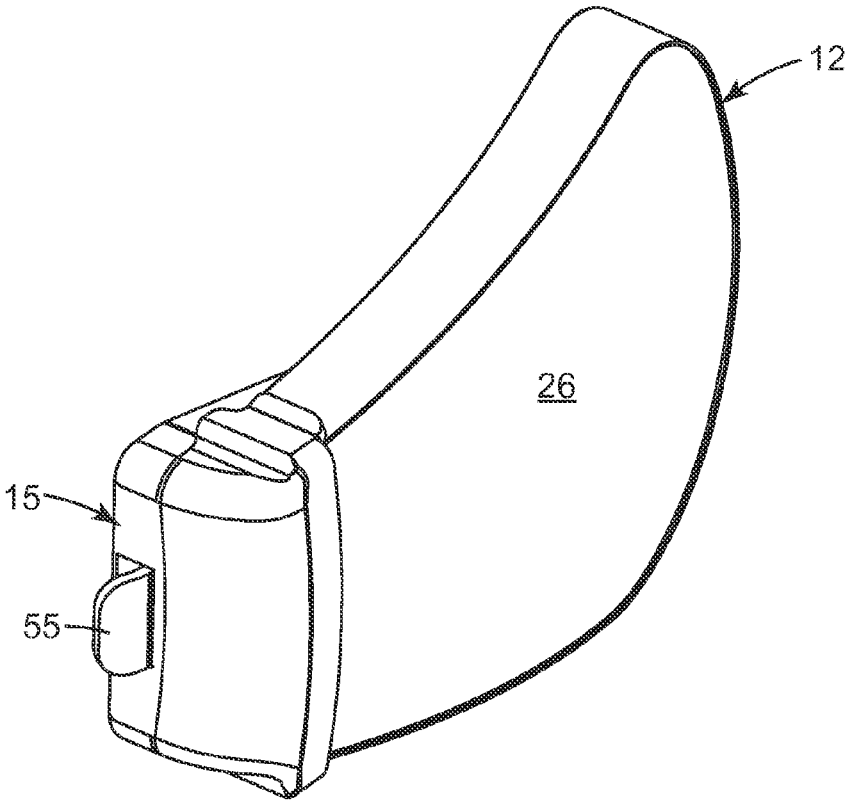
FIG. 7 is a front perspective view of a third embodiment of an assembled filter cartridge 12 and a filter cartridge receptacle 15 in accordance with the present invention.
Figure 8:
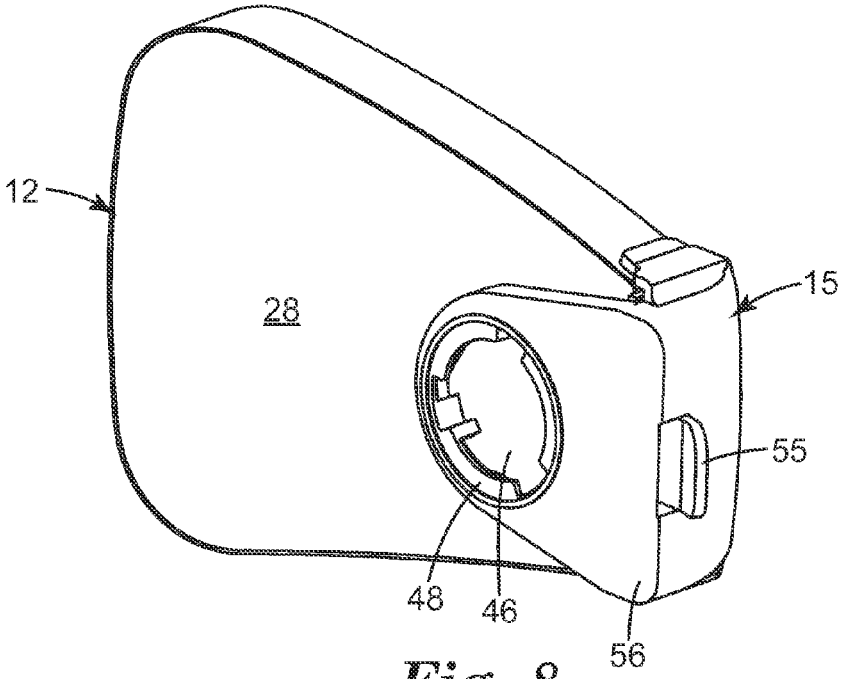
FIG. 8 is a rear perspective view of a third embodiment of an assembled filter cartridge 12 and a filter cartridge receptacle 15 in accordance with the present invention.
Figure 9:
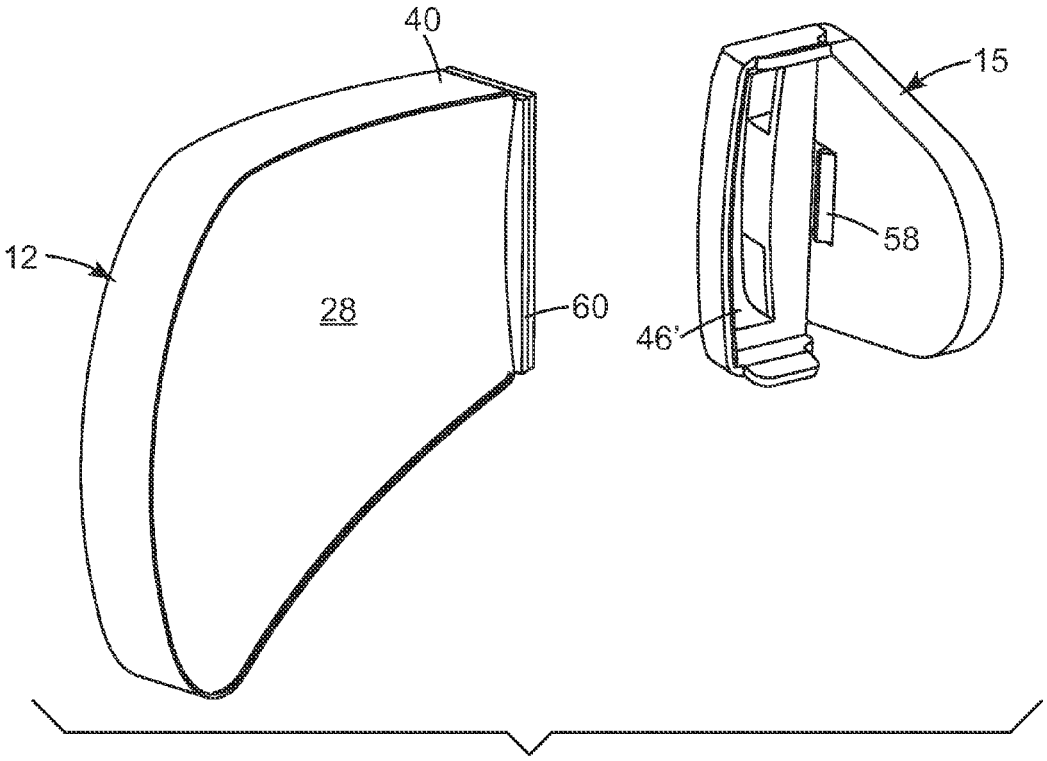
FIG. 9 is a rear perspective view of a third embodiment of a filter cartridge 12 separated from the filter cartridge receptacle 15 in accordance with the present invention.

FIGS. 5-6 show an alternative embodiment for attaching a filter cartridge 12 to a mask body 14. In this embodiment, the receptacle 15 is integral to the mask body 14. The cartridge 12 has a loop 53 that engages a releasable clip of the cartridge attachment mechanism located within the interior of receptacle 15. To remove the filter cartridge 12, a release button 54 may be pressed to disengage the interior clip from the cartridge loop 53. In this embodiment, clean air passes from an opening 42 in the front side 34 of the filter cartridge 12 through an adjacent opening 46' in the receptacle 15 and then into the interior gas space of the mask body 14. In this embodiment, the opening 42 faces the opening 46' and it does not use a bayonet fitting to attach the receptacle 15 to the mask body. Air also does not pass through an opening in the bayonet fitting to enter the mask body interior. Air passes directly from the opening into the receptacle to a passageway leading into the interior gas space of the mask body.

Figure 10:
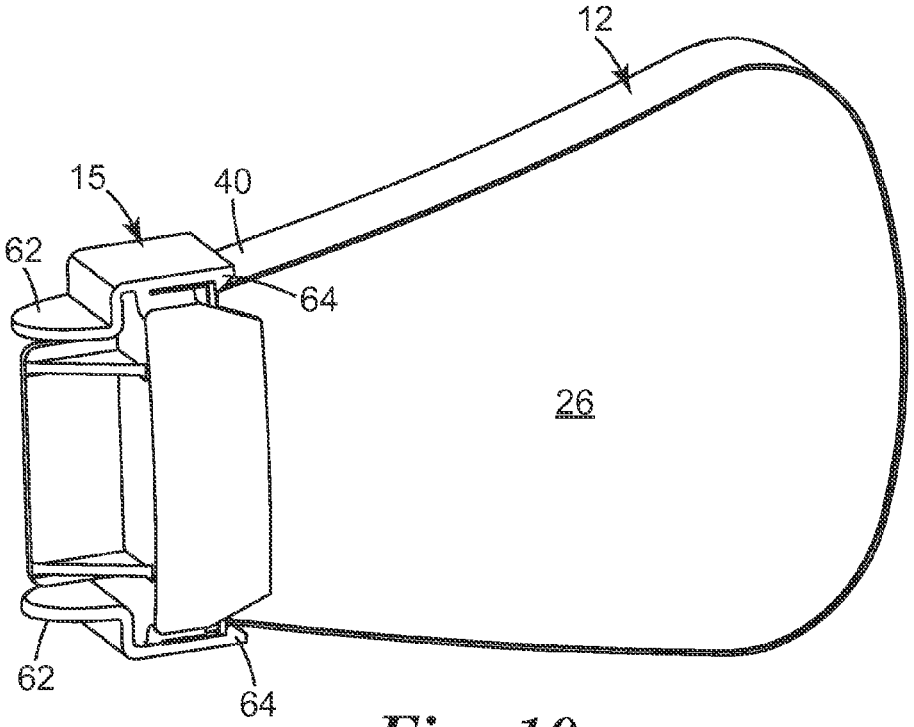
FIG. 10 is a front perspective view of a fourth embodiment of a filter cartridge 12 attached to a filter cartridge receptacle 15 in accordance with the present invention.
Figure 11:
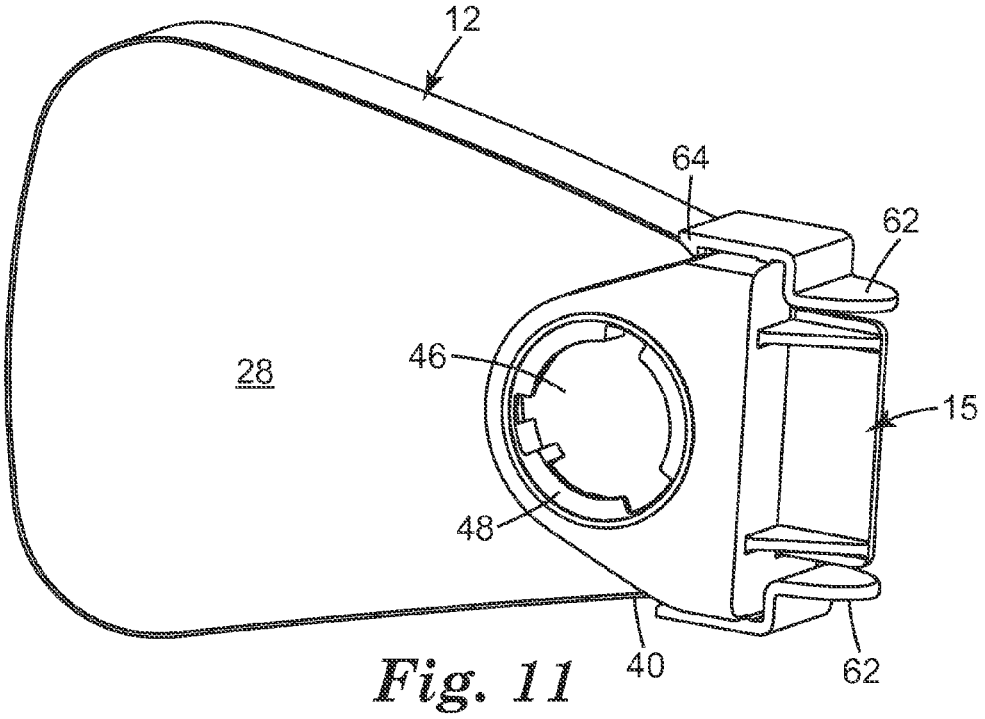
FIG. 11 is a rear perspective view of a fourth embodiment of an assembled filter cartridge 12 and a filter cartridge receptacle 15 in accordance with the present invention.
Figure 12:
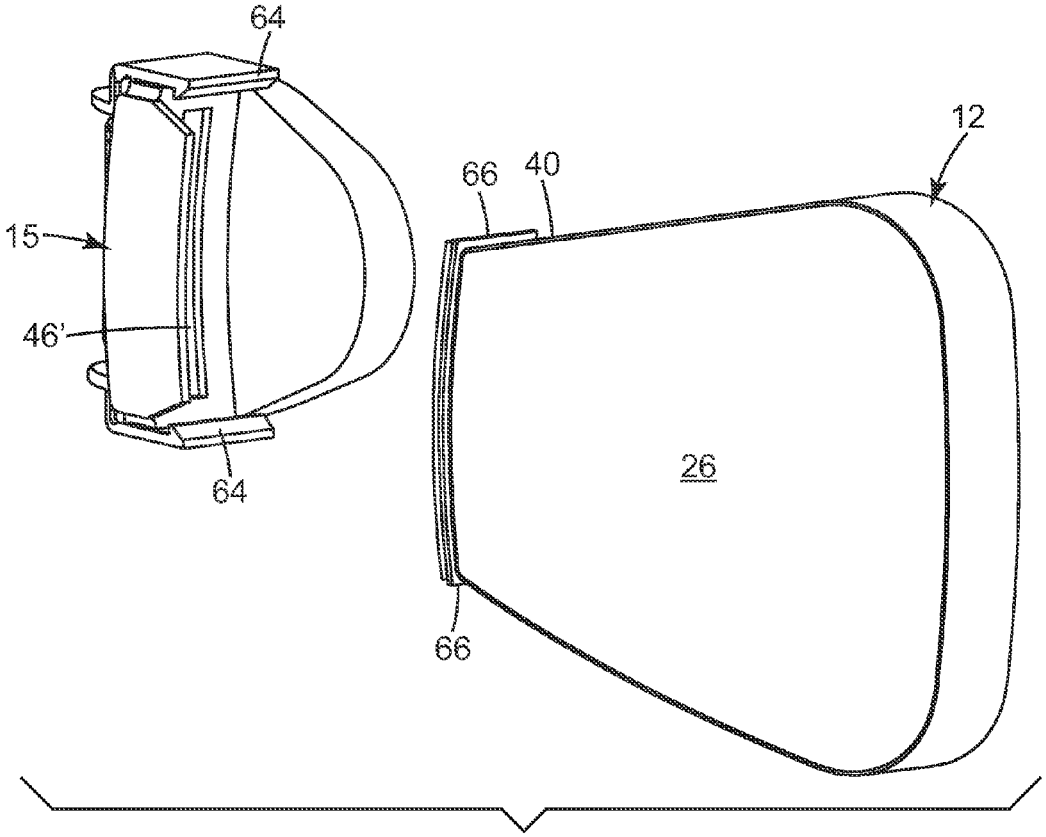
FIG. 12 is a rear perspective view of a fourth embodiment of a filter cartridge 12 separated from the filter cartridge receptacle 15 in accordance with the present invention.
Figure 13:
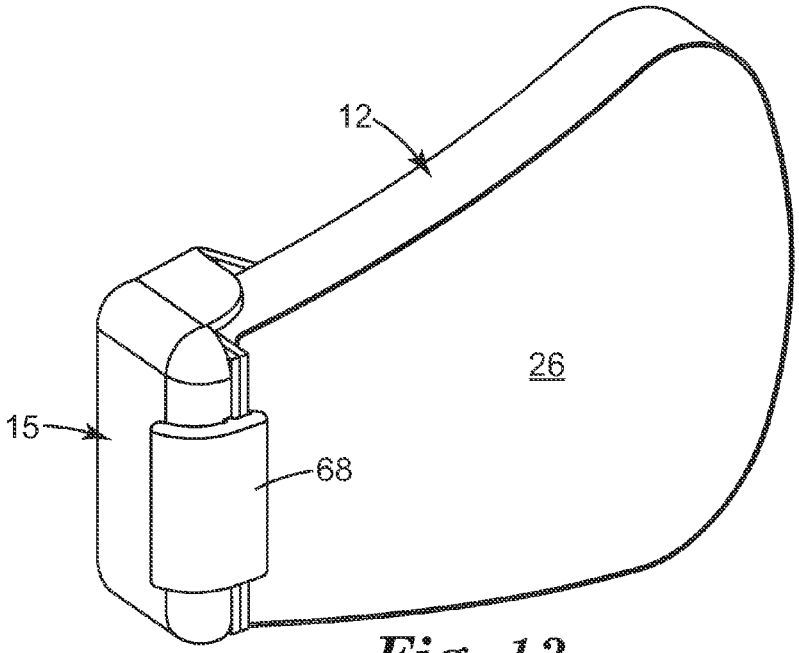
FIG. 13 is a front perspective view of a fifth embodiment of a filter cartridge 12 attached to a filter cartridge receptacle 15 in accordance with the present invention.
Figure 14:
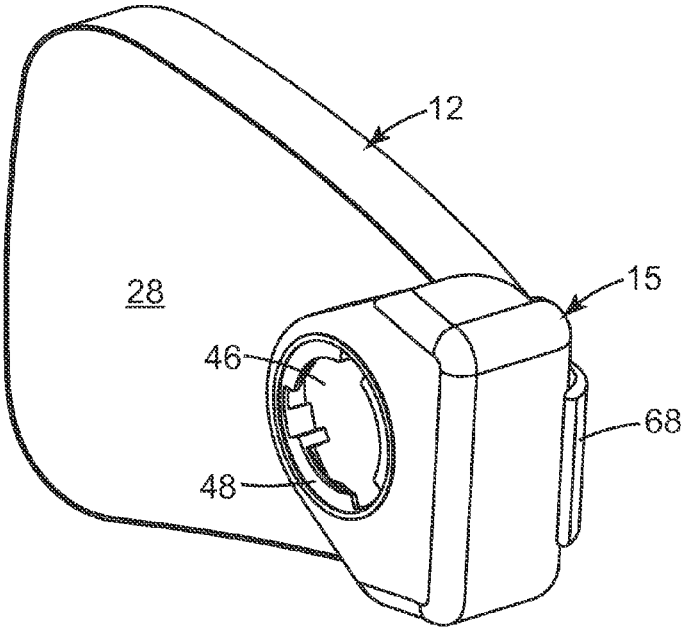
FIG. 14 is a rear perspective view of a fifth embodiment of an assembled filter cartridge 12 and a filter cartridge receptacle 15 in accordance with the present invention.
Figure 15:
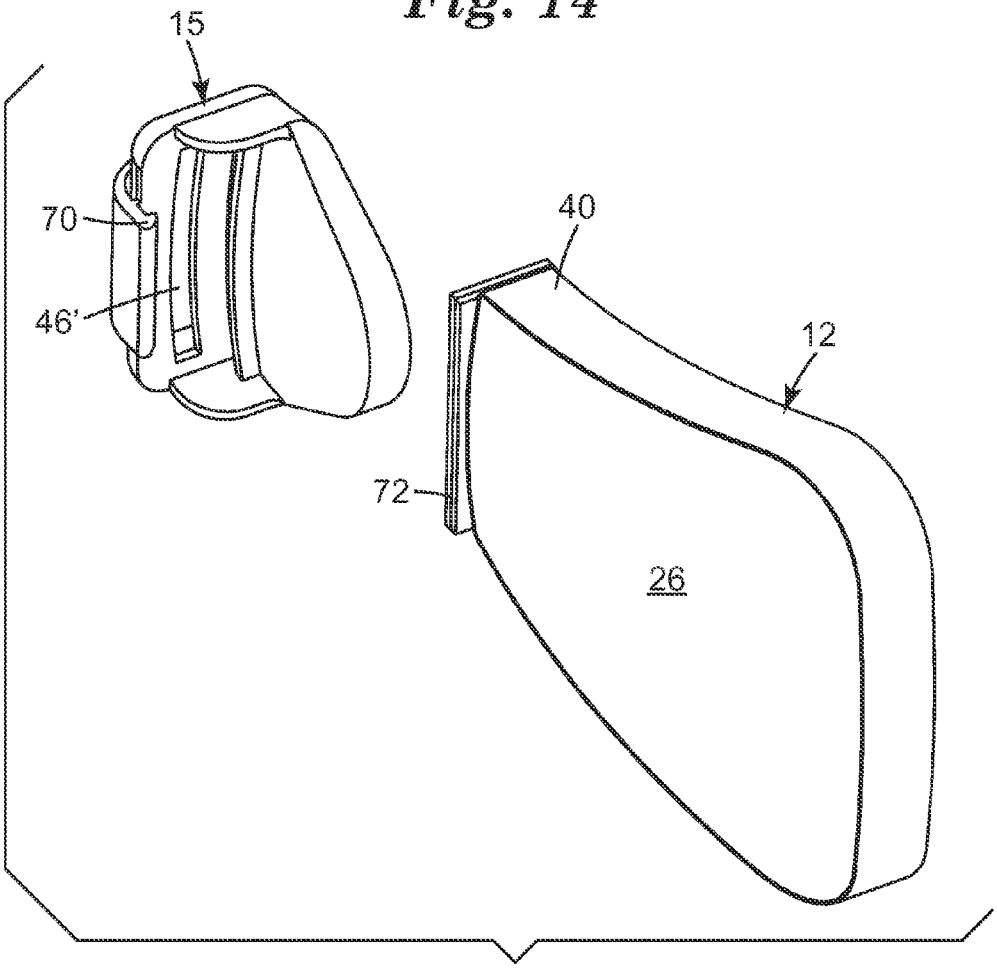
FIG. 15 is a rear perspective view of a fifth embodiment of a filter cartridge 12 separated from the filter cartridge receptacle 15 in accordance with the present invention.

FIGS. 7-15 show alternative embodiments of means for attaching and disengaging filter cartridges 12 to and from receptacles 15 in accordance with the present invention. In the embodiment shown in FIGS. 7-9, the receptacle 15 has an attachment mechanism that includes a moveable tab 55 that the user pulls to disengage the filter cartridge 12 from the receptacle 15. When the tab 55 is pulled away from the inward face 56 (FIG. 8) of the receptacle 15, the securement tab 58 retracts inward to disengage from projecting lip 60 (FIG. 9) located at the insertion end 40 of the filter cartridge 12. FIGS. 10-12 show an embodiment that has one or more tabs 62 on opposing sides of the receptacle 15, which can be pressed toward each other to cause the projecting flanges 64 to disengage from the respective lips 66 (FIG. 12) located at the first end 40 of the filter cartridge 12. FIGS. 13-15 show an embodiment where the filter cartridge/receptacle 12/15 engagement mechanism includes a latch 68 on the receptacle 15, which latch 68 can be opened to cause the engagement surface 70 to disengage from the lip 72 located at the first end 40 of the filter cartridge 12. When inserting the filter cartridge 12 into the receptacle 15, the lip 72 causes the latch to be pushed outwardly until the lip 72 passes beneath the latch 70. Once the cartridge is in its desired position, the latch 70 engages the lip 72 to cause the first end 40 of the cartridge 12 to be secured in the receptacle 15. Like other embodiments, the engagement mechanism may be spring-loaded to provide an audible click to let the user know that proper engagement has been achieved. In addition to, or in lieu of, an audible click, the means for indicating proper securement may be, for example, visible indicator such as a flag or a color marker.

EXAMPLE

A filter cartridge that has a loop and an attachment mechanism that includes a receptacle, a clip, and a release button was produced, which resembled the filter cartridge shown in FIG. 5. The loop, receptacle, clip, and button were built using rapid prototype stereolithography. The filter cartridge contained several filter media layers that were cut to a shape corresponding to the outline of the housing sidewall. The cartridge contained first and second major exterior surfaces through which ambient air passed to enter the interior gas space after passing through the filter media. The filter media contained four layers of particulate filter media and four layers of gaseous filter media. The filter media layers were sealed along the edge to a cardboard housing sidewall using a hot melt adhesive. The first and second major surfaces each had an exposed surface area of 69 $cm^2$. The loop body was sandwiched within the cartridge filter media, with the loop feature protruding from an opening located in the cartridge side. The clip and release button were assembled in the receptacle to produce the attachment mechanism. The receptacle was attached to a mask body. The assembled respirator was then donned, and the filter cartridge was plugged into the receptacle by sliding the engageable side portion towards a rear of the receptacle. While in engagement, the second major surface of the filter cartridge was spaced from the mask body at 0.5 mm at its closest spacing. The filter cartridge was then removed from the receptacle by pressing the release button. This operation was performed by different test subjects and demonstrated that the invention provided a new, secure, and convenient method of filter attachment and disengagement.

What is claimed is:

1. A respirator that comprises:

a mask body;

a female filter cartridge receptacle that is secured directly to the mask body; and a filter cartridge comprising first and second major surfaces and a male end, wherein at least a portion of the male end is disposed between the first and second major surfaces, and wherein the male end is capable of being plugged into the female filter cartridge receptacle;

wherein the spacing between the second major surface of the filter cartridge and the mask body is less than 1 centimeter at the closest distance between the second major surface and the mask body.

2. The respirator of claim 1, wherein the receptacle is capable of being removably attached to the mask body.

3. The respirator of claim 2, wherein the receptacle includes a means for attaching the receptacle to the mask body.

4. The respirator of claim 1, wherein the receptacle is integral to the mask body.

5. The respirator of claim 1, wherein the second major surface is flush with the mask body.

6. The respirator of claim 1, wherein the filter cartridge does not need to be rotated or manipulated other than being slid to create an attachment to the mask body receptacle.

7. The respirator of claim 1, wherein the filter cartridge may be disengaged by the user simply by pushing a disengagement mechanism.

8. The respirator of claim 7, wherein the disengagement mechanism comprises a button, tab, or a latch.

9. The respirator of claim 7, wherein the disengagement mechanism is a release button.

10. The respirator of claim 1, wherein the respirator comprises an attachment mechanism for securing the cartridge to the receptacle, the attachment mechanism being spring loaded.

11. The respirator of claim 1, wherein one or both of the major surfaces is fluid permeable to allow ambient air to enter the filter cartridge to be filtered, and wherein the first and second major surfaces each have a surface area of 60 to 90 square centimeters.

12. The respirator of claim 11, wherein the filter cartridge is curved from front to back.

13. The respirator of claim 12, wherein the filter cartridge is curved from side to side.

14. The respirator of claim 1, wherein the filter cartridge has an opening located in the male end of the filter cartridge, the opening allowing for clean air to pass from the filter cartridge into an interior gas space of the respirator.

15. The respirator of claim 14, wherein the opening is located on a front sidewall of a housing of the filter cartridge.

16. The respirator of claim 1, wherein the second major surface of the filter cartridge faces the mask body.

17. A respirator that comprises:

a mask body;

first and second female filter cartridge receptacles that are each secured to the mask body; and a first filter cartridge comprising a male end plugged into the first female filter cartridge receptacle and a second filter cartridge comprising a male end plugged into the second female filter cartridge receptacle such that the first and second filter cartridges are located on opposing sides of the mask body, wherein each of the first and second filter cartridges further comprises a first major surface and a second major surface, wherein at least a portion of the male end of each of the first and second filter cartridges is disposed between the respective first and second major surfaces, wherein both the first major surface and the second major surface of each of the first and second filter cartridges are fluid permeable;

wherein the spacing between the second major surface of at least one of the first and second filter cartridges and the mask body is less than 1 centimeter at least closest distance between the second major surface and the mask body.

18. The respirator of claim 17, wherein the respirator is configured such that air can pass through the first and second major surfaces of each of the first and second filter cartridges and enter a plenum located in each of the first and second filter cartridges that is in fluid communication with an opening in each of the respective first and second filter cartridge receptacles.

19. The respirator of claim 18, wherein each of the first and second filter cartridges comprises a conduit formed in the male end that allows for air to pass from the plenum to the respective filter cartridge receptacle.

* * * * *